United States Patent [19]

Szarka

[11] Patent Number: 4,819,559

[45] Date of Patent: Apr. 11, 1989

[54] PALLET ASSEMBLY FOR IMPROVED PRINTING OPERATION

[75] Inventor: Sandor Szarka, Franklin Lakes, N.J.

[73] Assignee: Precision Screen Machines, Inc., Hawthorne, N.J.

[21] Appl. No.: 105,326

[22] Filed: Oct. 7, 1987

[51] Int. Cl.[4] ..... B41F 15/18

[52] U.S. Cl. ..... 101/474; 101/126; 38/136

[58] Field of Search ..... 101/126, 115, 407 BP; 38/136, 64, 66, 112, 34, 36; 108/13, 4; 292/304

[56] References Cited

U.S. PATENT DOCUMENTS

| | | | |
|---|---|---|---|
| 580,017 | 4/1897 | Sutton et al. | 38/136 X |
| 3,244,093 | 4/1966 | Vasilantone | 101/126 |
| 4,031,825 | 6/1977 | Jaffa | 101/126 |
| 4,315,461 | 2/1982 | Harpold | 101/126 X |
| 4,689,905 | 9/1987 | Vartan | 38/136 X |

FOREIGN PATENT DOCUMENTS

| | | | |
|---|---|---|---|
| 2310218 | 12/1976 | France | 101/407 BP |

*Primary Examiner*—Clifford D. Crowder

*Attorney, Agent, or Firm*—Hopgood, Calimafde, Kalil, Blaustein & Judlowe

[57] ABSTRACT

A pallet assembly for a multi-station printing machine, where the pallet is transported by an indexing arm, is secured to the arm by a ball and socket hinge assembly with the distal end of the pallet engaged over a keeper pin so that the pallet can selectably be disengaged from the pin and rotated about its longitudinal axis in order to turn over a garment disposed on the pallet and thereby permit imprinting the garment on both sides. A support structure extends laterally beyond the edges of the pallet in order to support an overhanging screen and squeegee whereby printing of the garment surface can be effected to the extreme side edges.

6 Claims, 5 Drawing Sheets

PALLET ASSEMBLY FOR IMPROVED PRINTING OPERATION

BACKGROUND OF THE INVENTION

This invention relates to printing indexers used for multicolor printing. More particularly, this invention relates to an improved pallet assembly which provides full surface, two-sided printing on various types of fabrics and garments.

Various forms of semi-automatic printing apparatus and indexers for printing multiple color images on fabric material are described in the prior art. Typically, reference may be had to U.S. Pat. Nos. 2,229,346; 2,694,973; 3,416,440; Re. 29,160; and 4,099,460. Generically, this class of equipment is characterized by a number of fixed pallets oriented radially around a vertical axis. In operation, garments or other fabric material to receive print images are placed on pallets so that the upper surface of the fabric is exposed for printing. The pallets are then "indexed" around the vertical axis to individual print stations located around the periphery of the printing indexer.

Located at each of the print stations is an appropriate printing device, e.g., a screen printer, whose operation is synchronized with the movement of the indexer. As would be understood by one skilled in the art, once each pallet is properly indexed, the printers are activated such that a screen or similar pattern transferring device is positioned onto the print receiving medium on the pallet. With a screen printer an applicator in the form of a roller or squeegee then contacts the screen and traverses the surface thereof causing the print image to be transferred onto the garment or other fabric located on the pallet. After the applicator completes its travel, the printing machine disengages the pallet by lifting both the applicator and screen from the print receiving medium, and the pallet then proceeds to the next print station for further printing.

In order for a pallet assembly to function properly as a garment holder, it must be shaped generally to the configuration of the garment which it will support. In this manner, the garment may be slipped over the pallet exposing a single surface for printing. The other side of the garment is protected by the pallet from any "strike through" during the printing operation.

In addition, the pallet must be fixed in relationship to the indexing drive mechanism during the print cycle so as to ensure accurate and positive indexing and print registration from one print station to the next. To accomplish this, past pallet designs have relied upon rigid connections which immobilize the pallet relative to the drive mechanism.

Although these prior art mechanisms operate satisfactorily, they suffer from several major disadvantages. Since the pallet is fixed in relationship to the drive mechanism, only the originally exposed surface is available for printing. If an imprint is desired on the opposite side of the garment, the garment must be removed from the pallet and repositioned back onto the pallet exposing the new surface. This manual operation is not only time-consuming and difficult to perform accurately, but in many instances the operator is required to handle the printed surface prior to complete drying frequently resulting in smearing or otherwise damaging the printed design.

Another problem inherent in past designs of the pallet assembly involves the actual printing operation. As discussed above, printing is accomplished at each print station by placing a screen containing the image to be transferred onto the fabric on the pallet. A flexible squeegee is then drawn across the length of the screen imprinting the fabric with the print image. Heretofore, the squeegee was selected no wider than the pallet so as not to overlap the side edges of the pallet. Overlapping the side edges of the pallet has tended to wear and damage the screen material and so was to be avoided. But this has placed a limitation on the width of the printable image and has prevented printing all the way to the edge of the fabric or garment.

SUMMARY OF THE INVENTION

Accordingly, it is an object of the present invention to provide an improved pallet assembly which is adapted to be positively and accurately indexed between a plurality of printing stations.

Another object of the present invention is to provide an assembly that can be quickly and easily inverted to expose a second side of a garment thereon for receiving print images without the need for the operator removing the garment from the pallet or otherwise handling the garment. A further object of the present invention is to provide a pallet assembly that can be easily located in a print position to assure accurate indexing between print stations.

Still another object of the present invention is to provide a pallet support member beneath the pallet with side edges that extend beyond the pallet side edges thereby permitting printing across the entire exposed surface of the garment without damaging the screen.

Still other objects and advantages of the present invention will be become apparent from the following summary of the invention and description of the preferred embodiments.

In accordance with one aspect of the present invention there is provided a pallet assembly for use in a printing indexer comprising: a substantially plate-like pallet bounded by side edges and upon which a garment can be placed to receive print images; a hinge assembly joining one of said side edges of the pallet to a transport member of the printing indexer, said hinge assembly having at least two axes of freedom for permitting movement of said pallet relative to said transport member; and keeper means located on said transport member adjacent said pallet side edge that is spaced distally from said hinge assembly for engaging said pallet and positioning said pallet on said transport member.

BRIEF DESCRIPTION OF THE DRAWINGS

The invention will be better understood after reading the following detailed description of the presently preferred embodiments thereof with reference to the appended drawings in which.

The same reference characters are used throughout the several figures of the drawings to designate the same or similar parts.

DETAILED DESCRIPTION OF THE PRESENTLY PREFERRED EMBODIMENTS

Figure 1:
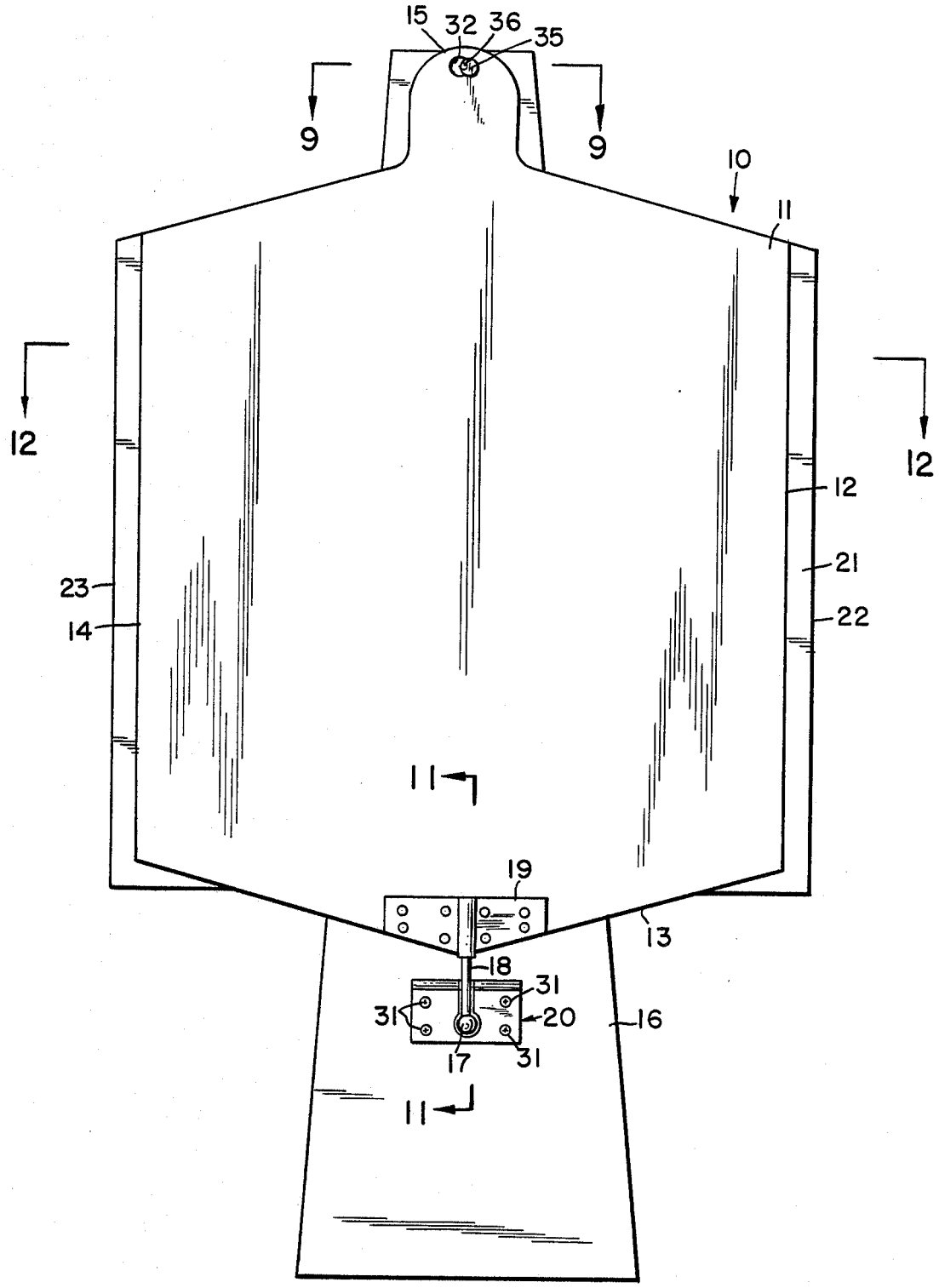
FIG. 1 is a top plan view of an indexing arm supporting a pallet assembly in accordance with the present invention.

Reference should now be had to the drawings wherein the pallet assembly is designated generally by the reference numeral 10 and is shown in the form of a plate-like pallet 11 bounded by side edges 12, 13, 14 and 15. The pallet 11 is joined at its side edge 13 to a transparent member in the form of an indexing arm 16 by a hinge assembly in the form of a ball and socket structure in which the ball 17 is located at the end of a stem 18 projecting from a mounting plate 19, and the socket is formed in a block 20 secured to the indexing arm 16. In addition, the pallet assembly includes a flat pallet support member 21 attached to the indexing arm 16 between the pallet 11 and arm 16 parallel to both. As best seen in FIG. 1, the support member 21 has the same general shape as the pallet 11 but is somewhat wider than the pallet 11 such that the lateral side edges 22 and 23 of the support member 21 project or extend laterally beyond the lateral side edges 12 and 14, respectively, of the pallet 11. The reason for this lateral extension will be explained in greater detail below.

Figure 2:
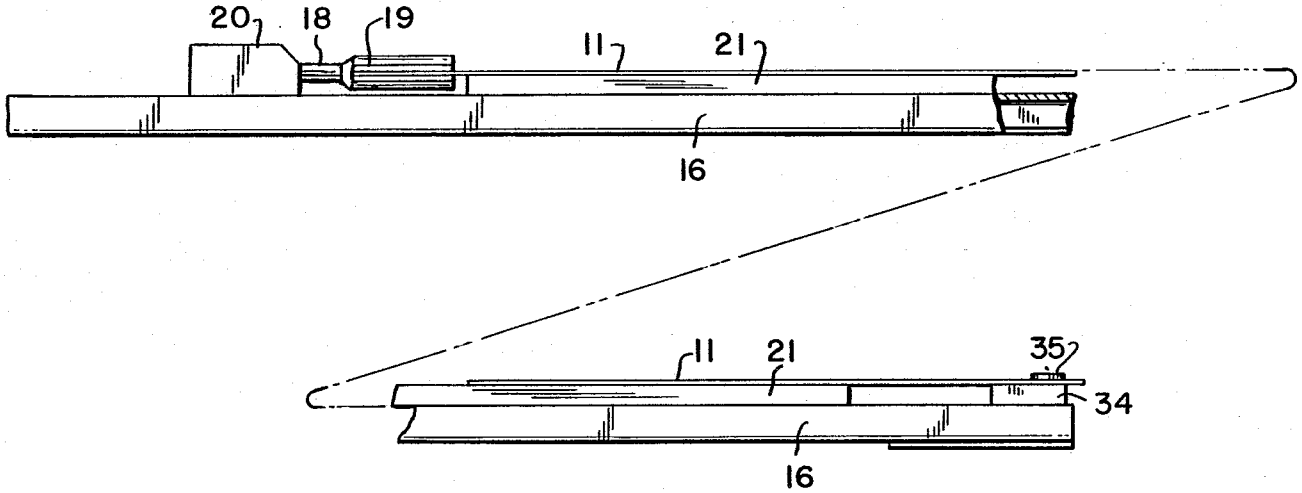
FIG. 2 is a side view of the structure of FIG. 1 with portions broken away.
Figure 4:
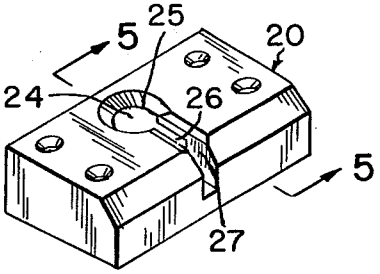
FIG. 4 is a perspective view of the socket block that forms a part of the hinge assembly of the structure shown in FIG. 1.
Figure 3:
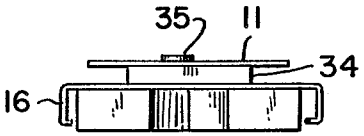
FIG. 3 is an end view of the assembly of FIGS. 1 and 2 as viewed from the right side of FIG. 2.
Figure 5:
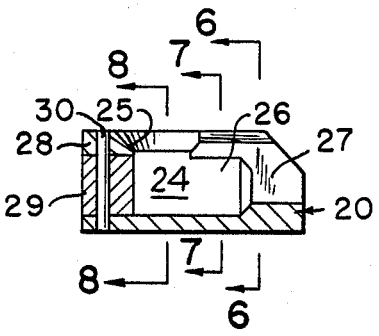
FIG. 5 is a transverse sectional view taken along the line 5—5 in FIG. 4.
Figure 6:
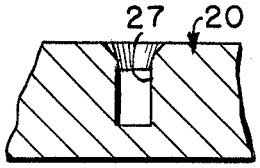
FIG. 6 is a fragmentary sectional view taken along the line 6—6 in FIG. 5.
Figure 7:
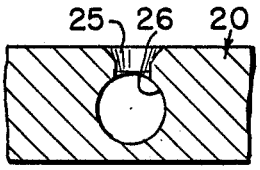
FIG. 7 is a fragmentary sectional view taken a long the line 7—7 of FIG. 5.
Figure 8:
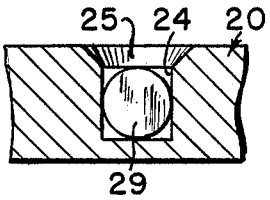
FIG. 8 is a fragmentary sectional view taken along the line 8—8 in FIG. 5.

As best seen in FIG. 2, the pallet 11 is of relatively thin construction and the support member 21 is disposed immediately beneath the pallet 11.

The socket block 20 of the hinge assembly is specially constructed, the details of which can be appreciated from a consideration of FIGS. 4 to 8. As seen therein, the block 20 has a ball receiving bore 24 having an opening 25 through which the ball 17 can be inserted or removed. In addition, the block 20 has a ball capturing channel portion 26 and a rectangularly sided slot 27 for receiving the stem 18. The stem 18 has a round cross section and the hinge assembly is dimensioned so that the stem is received with the slot 27 with slip fit. As a method of machining the block 20, the channel 26 is produced by boring a hole in from the side 28 of the block 20 and then plugging the back end of the hole with a round plug 29 fastened by a pin 30. The block 20 is secured to the arm 16 by appropriate fasteners 31 (See FIG. 1).

Figure 9A:
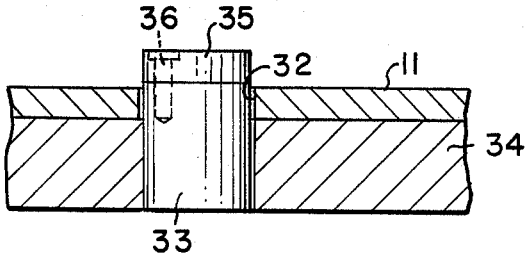
FIGS. 9*a* and 9*b* are enlarged fragmentary sectional views taken along the line 9—9 in FIG. 1 and showing details of one embodiment of the keeper means that includes a locking component, FIG. 9*a* showing the released or unlocked condition of the locking componeent and FIG. 9*b* showing the locked condition.
Figure 9B:
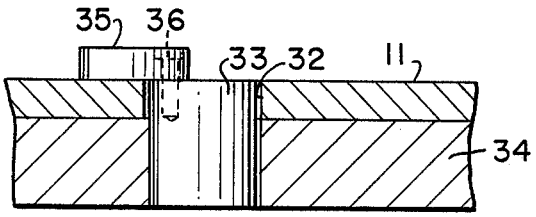

As shown in FIGS. 1 and 2 the pallet 11 is in secured position for imprinting an image at a print station of the printing machine. As best seen in FIGS. 9*a* and 9*b* the pallet 11 is provided with an aperture 32 at its end which is remote from the hinge assembly 19 and 20. The aperture 32 is passed over a pin 33 which extends upward above the surface of a mounting block 34 located, in turn, on the outboard end of the indexing arm 16. The pin 33 has secured to its upper or exposed end a washer or disc element 35 fastened eccentrically by a pivot member 36 to the pin 33. By reason of the eccentric mounting of the washer 35 it can be rotated about pivot 36 between a releasing position shown in FIG. 9*a* and a locking position shown in FIG. 9*b*. In the latter position the washer 35 overlies an edge of the aperture 32, thereby capturing the end of the pallet 11 and holding it secure about the pin 33. When it is desired to release the pallet, the washer 35 can be rotated into the position shown in FIG. 9*a* where it coincides with the top end of pin 33, and the end of the pallet 11 then can be separated from the pin assembly in an obvious manner.

Figure 13:
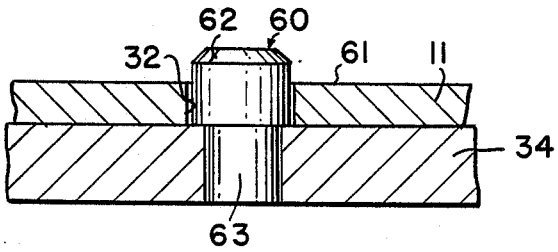
FIG. 13 is a view similar to FIGS. 9*a* and 9*b* showing a modification of the keeper means in which the locking component is omitted.

While the use of a keeper with a locking component as shown in FIGS. 9*a* and 9*b* provides a "locked" condition for the pallet 11, it has been found that a locking component is unnecessary and that satisfactory positioning of the pallet 11 can be assured by extending the keeper pin as shown in FIG. 13. In this modification the pin 60 is made long enough to project from the mounting block 34 through the aperture 32 in pallet 11 to a point above the upper surface 61 of pallet 11. The exposed end of pin 60 is bevelled at 62 to facilitate positioning aperture 32 over pin 60. As shown in the drawing, pin 60 has a reduced diameter shank 63 which, upon introduction in block 34, provides a shoulder on pin 60 that engages the upper surface of block 34 and locates the pin 60 relative thereto.

Figure 11A:
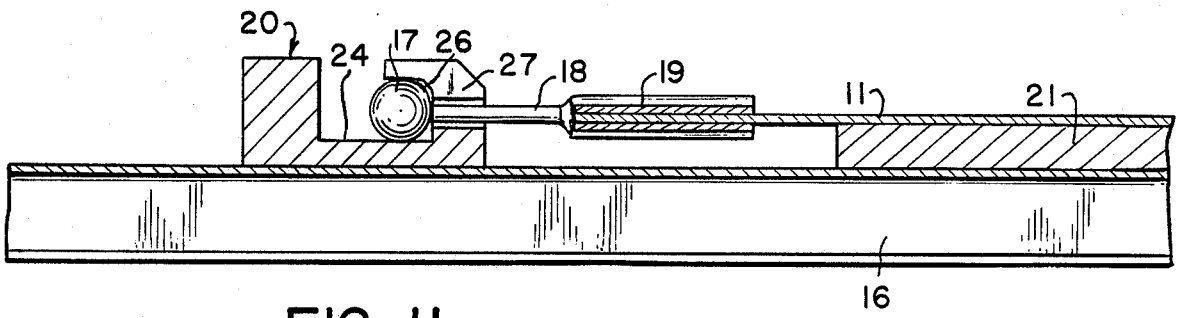
FIGS. 11*a*, 11*b* and 11*c* are a series of fragmentary longitudinal sectional views taken along the line 11—11 in FIG. 1 and showing the articulation and multiple freedom of motion of the hinge assembly of FIG. 1.
Figure 11B:
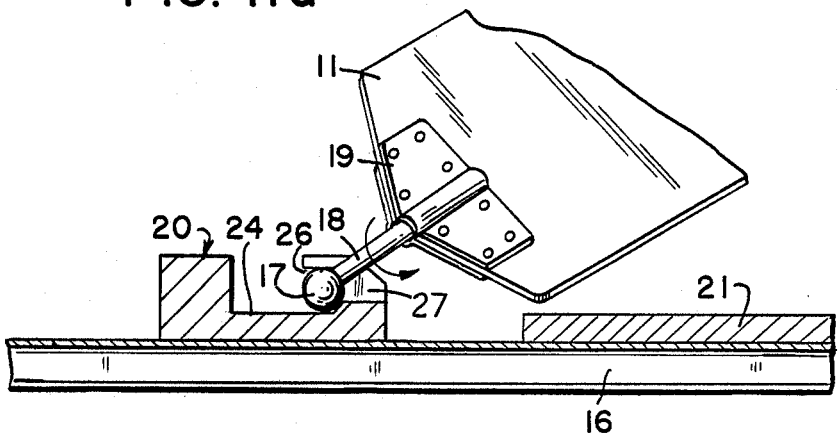
Figure 11C:
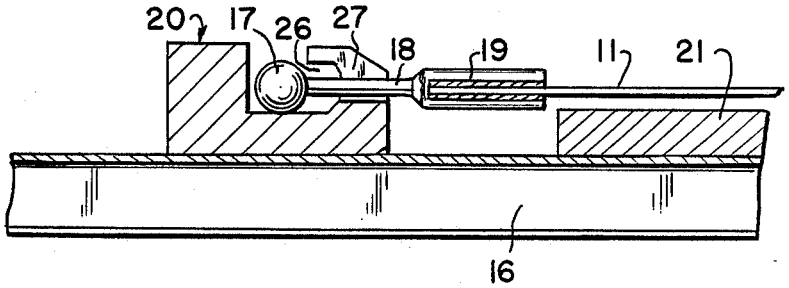

Attention should now be directed to FIGS. 11*a*, 11*b* and 11*c*. As seen in FIG. 11*a*, the ball 17 is "captured" within the channel or cavity 26 of the block 20 when the aperture 32 in the pallet 11 is disposed on keeper pin 33 or 60. In this condition, the pallet 11 is substantially immobile in print receiving position relative to the indexing arm 16. Imprinting of a pattern or image on a garment installed on the pallet 11 can be accomplished in any known manner. Having imprinted one side of the garment, the washer or retaining member 35, if present, can be rotated to release the end of the pallet. In any case, pallet 11 is elevated into the position shown in FIG. 11*b* and rotated about the longitudinal axis of the ball stem 18 and then returned to the position shown in FIG. 11*a* with the reverse side of the garment exposed for printing. When it is desired to change the pallet to one of a different size, it is only necessary to separate the end of the pallet from the pin 33 or 60 and move the ball 17 to the position shown in FIG. 11*c* where it can now be removed or separated from the socket block 20.

Figure 10:
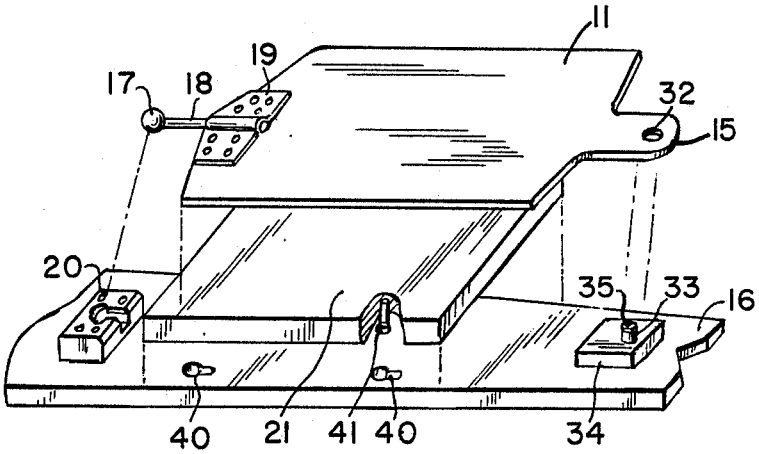
FIG. 10 is an exploded perspective view of the structure of FIG. 1 illustrating certain additional details in construction thereof.

Whenever the pallet 11 is replaced by one of a different size, it is necessary to also replace the support member 21 with one of comparable size. The manner in which this can be effected is best appreciated from a consideration of FIG. 10 wherein it is shown that the support member 21 is releasably secured to the indexing arm 16 by a series of keyhole slots 40 formed in the arm 16 that are engageable by a mating series of mushroom headed studs 41 that extend beneath the support member 21. There are four slots 40 arranged at the four corners of a rectangle although only two are visible in the drawing.

It should now be apparent that the disclosed structure provides a pallet assembly wherein the ball and socket structure 19 and 20 permits rotation of the pallet 11 about an axis lying in the plane of the pallet and extending substantially distally from the hinge assembly. Such rotation is permitted whenever the end 15 of pallet 11 is disengaged from the keeper pin 33 or 60. This permits a garment on the pallet to be turned over for imprinting the opposite side. The supporting stem 18 for the ball 17, as best seen in FIG. 2, is substantially co-planar with the pallet 11. The stem is generally straight and has a longitudinal axis co-axially disposed relative to the axis that extends between the hinge assembly and the distal edge of the pallet 11 which distal edge is engageable by the keeper means 33 or 60. When the keeper means and the pallet 11 are separated, the pallet can be articulated about the center of the ball 17 into an inclined position and, as so inclined, can be rotated as mentioned above.

Figure 12:
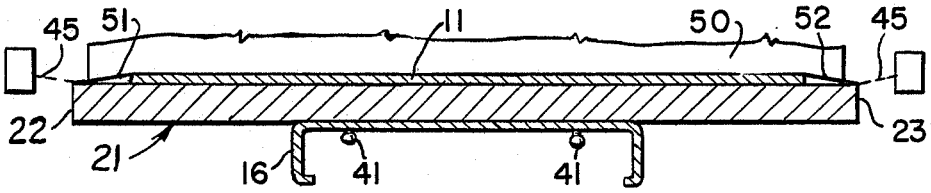
FIG. 12 is a transverse sectional view taken along the line 12—12 in FIG. 1 and showing symbolically the relationship of squeegee, screen and pallet assembly during a printing operation.

With the arrangement described above, and particularly with the provision of the support member 21, as best seen in FIG. 12, printing can be accomplished to the extreme side edges of the garment that is disposed on the pallet. As shown in FIG. 12 the screen 45 overlaps the side edges of the pallet 11 and garment and is pressed downward by the squeegee 50 in the regions 51 and 52 where the squeegee 50 extnds laterally beyond the pallet side edges. However, the screen 45 encounters the exposed edges 22 and 23 of the support member 21 and is prevented from being deformed excessively over the edges of the garment and pallet.

The pallet assembly, as observed from FIG. 12, is constructed with the pallet 11 being sufficiently thin and the support member 21 being disposed immediately beneath the pallet such that the laterally projecting edges 22 and 23 of the support member 21 provides support for the image imprinting elements, namely the screen 45 and squeegee 50, when they engage a garment on the pallet 11 and overhang the width of the pallet. It has been found that this support substantially increases the life of the screen. It should also be appreciated that with this arrangement printing can be accomplished to the extreme edges of the garment and need not be stopped short thereof.

Having described the presently preferred embodiments of the subject invention, it will be appreciated by those skilled in the art that various changes in details of construction can be effected without departing from the true spirit of the invention as defined in the appended claims.

What is claimed is:

1. A printing indexer pallet assembly comprising: a substantially plate-like pallet bounded by side edges and upon which a garment can be placed to receive print images; a hinge assembly joining one of said side edges of the pallet to a transport member of a printing indexer, said hinge assembly having at least two axes of freedom for permitting movement of said pallet relative to said transport member, said hinge assembly being adapted to effectuate mounting, selectively rotating and removal of said garment to be printed upon; keeper means located on said transport member adjacent said pallet side edge that is spaced distally from said hinge assembly for engaging said positioning said pallet on said transport member; and a flat parallel support member, between and parallel to said pallet and said transport member, said support member having the same general shape as said pallet but being wider than said pallet such that said support member, having lateral edges, projects laterally beyond the lateral side edges of said pallet, wherein the thickness of said pallet is sized such that said pallet support member supports the image imprinting elements when they engage a garment on said pallet and overhang the width of said pallet.

2. A printing indexer pallet assembly comprising: a substantially plate-like pallet bounded by side edges and upon which a garment can be placed to receive print images; a hinge assembly joining one of said side edges of the pallet to a transport member of a printing indexer, said hinge assembly having at least two axes of freedom for permitting movement of said pallet relative to said transport member, said hinge assembly being adapted to effectuate mounting, selectively rotating and removal of said garment to be printed upon; keeper means located on said transport member adjacent said pallet side edge that is spaced distally from said hinge assembly for engaging and positioning said pallet on said transport member; and wherein said hinge assembly comprises a ball and socket structure permitting rotation of said pallet about an axis lying in its place and extending substantially distally from said hinge assembly, such rotation being enabled whenever said pallet is separated from said keeper means, whereby a garment on said pallet can be turned over for imprinting the opposite side.

3. The pallet assembly of claim 2, wherein said keeper means comprise: a pin mounted on said transport member and positioned with a projecting end to be engaged by an aperture in said pallet located distally from said hinge assembly.

4. The pallet assembly of claim 3, wherein said keeper means further comprises: a locking washer eccentrically pivoted to said pin at said projecting end for capturing said pallet by overlying an edge of said aperture when the latter is installed over said pin.

5. A pallet assembly for use in a printing indexer comprising: a substantially plate-like pallet bounded by side edges and upon which a garment can be placed to receive print images; ball and socket assembly joining one of said side edge of the pallet to a transport member of a printing indexer, said ball and socket having at least two axes of freedom for permitting movement of said pallet relative to said transport member and permitting rotation of said pallet about an axis lying in its plane and extending substantially distally from said ball and socket assembly; and keeper means located on said transport member adjacent said pallet side edge that is spaced distally from said ball and socket assembly for engaging and positioning said pallet on said transport member, wherein said keeper means comprises a pin, mounted on said transport member and positioned with a projecting end to be engaged by an aperture in said pallet located distally from said ball and socket assembly, wherein said keeper means further comprises a locking washer eccentrically pivoted to said pin at said projecting end for capturing said pallet by overlying an edge of said aperture when the latter is installed over said pin.

6. A pallet assembly for use in a printing indexer comprising: a substantially plate-like pallet bounded by side edges and upon which a garment can be placed to receive print images; a ball and socket unit, said socket being formed in a first part joined to said transport member, and said ball being formed at the end of a stem the other end of which is joined to said one side edge of said pallet supporting said stem substantially coplanar with said pallet; and keeper means located on said transport member adjacent said pallet side edge that is spaced distally from said hinge assembly for engaging and positioning said pallet on said transport member, wherein said stem is generally straight and having a longitudinal axis coaxially disposed relative to an axis extending between said ball and the distal edge of said pallet that is engageable by said keeper means, the arrangement of said ball and socket being such that said pallet can be articulated about the center of said ball when said pallet is disengaged from said keeper means to incline said pallet relative to said transport member and, when so inclined, said pallet is rotatable about said longitudinal axis of said stem for turning over a garment that is mounted on said pallet to permit imprinting selectably on both sides of said garment.

* * * * *